US005976196A

United States Patent [19]

Cooper et al.

[11] Patent Number: 5,976,196

[45] **Date of Patent: *Nov. 2, 1999**

[54] PROCESS FOR PREPARING A DYED TEXTILE FABRIC WHEREIN THE DYED FABRIC IS COATED WITH A MIXTURE OF RESINS

[75] Inventors: Anthony B Cooper; Richard T. Underwood; Geoffrey A. Monteith, all of Columbus, Ga.; Michael D. Wright, Auburn, Ala.

[73] Assignee: Callaway Corporation, Columbus, Ga.

[ * ] Notice: This patent is subject to a terminal disclaimer.

[21] Appl. No.: 09/094,927

[22] Filed: Jun. 15, 1998

[51] Int. Cl.[6] ..... D06P 5/08

[52] U.S. Cl. ..... 8/442; 8/494; 8/495; 8/552; 8/554; 8/555; 8/115.6; 8/194; 8/DIG. 17; 427/322

[58] Field of Search ..... 8/442, 494, 495, 8/555, 557, 115.6, 194, DIG. 17, 552, 554; 252/8.63; 427/322, 324; 525/450, 451, 452

[56] References Cited

U.S. PATENT DOCUMENTS

| | | | |
|---|---|---|---|
| 3,311,594 | 3/1967 | Earle et al. | 525/430 |
| 3,475,207 | 10/1969 | Berch et al. | 427/392 |
| 3,556,932 | 1/1971 | Coscia et al. | 162/166 |
| 4,128,398 | 12/1978 | Alpert | 8/127.6 |
| 4,531,946 | 7/1985 | Christie et al. | 8/192 |
| 4,599,087 | 7/1986 | Heller et al. | 8/495 |
| 4,605,702 | 8/1986 | Guerro et al. | 525/154 |
| 4,737,156 | 4/1988 | Tambor et al. | 8/490 |
| 4,883,604 | 11/1989 | Vaitenhansl et al. | 428/375 |
| 5,427,652 | 6/1995 | Darlington et al. | 162/164.3 |
| 5,674,362 | 10/1997 | Underwood et al. | 162/164.3 |
| 5,783,041 | 7/1998 | Underwood | 162/164.1 |

FOREIGN PATENT DOCUMENTS

97/30118 8/1997 WIPO .

*Primary Examiner*—Caroline D. Liott
*Attorney, Agent, or Firm*—Bruce F. Jacobs

[57] ABSTRACT

An improved method for fixing color of a dyed textile by coating a dyed textile with a mixture of (i) an aminopolyamide-epichlorohydrin resin and (ii) a glyoxylated acrylamide-dimethyl diallyl ammonium chloride resin.

17 Claims, No Drawings

PROCESS FOR PREPARING A DYED TEXTILE FABRIC WHEREIN THE DYED FABRIC IS COATED WITH A MIXTURE OF RESINS

FIELD OF THE INVENTION

The present invention is directed to an improved method for fixing color of dyed textile fabrics, particularly to increase the color retention and crocking resistance.

BACKGROUND OF THE INVENTION

Crocking is a transfer of color from the surface of a colored fabric to an adjacent area of the same fabric or to another surface principally by rubbing action. Crockfastness is color fastness to rubbing (crocking). The improvement of crockfastness/colorfastness of dyed textile fabrics has been an ongoing problem in the textile industry. Attempts to resolve the problem have entailed additives during the dyeing process as well as post treatments.

For example, U.S. Pat. No. 4,531,946 discloses use of a fabric finish containing a reactive polyamine derivative in combination with a blocked urethane for cellulosic and cellulosic blends which have been dyed with disperse/naphthol or disperse/sulfur disperse/vat dye systems. U.S. Pat. No. 4,737,156 discloses use of cationic cellulose graft copolymers for improving dye fastness to a dyed textile substrate by post dye application (top-up). U.S. Pat. No. 4,740,214 discloses a pattern dyeing process wherein an anionic and a cationic component come into contact with each other when a dye solution is applied to a textile. An ionic interaction is stated to occur to form a water-insoluble dye-impermeable skin around individual dye droplets which then controls undesired migration of the dye. One of the components is applied to a textile material prior to application of the dye solution in a desired pattern and then the corresponding counter-ionic material is applied as a component of the dye solution.

Glyoxylated polyacrylamide-diallyldimethyl ammonium chloride copolymer (GPA) resins are known for use as dry strength and temporary wet strength resins for paper. U.S. Pat. No. 4,605,702, for instance, teaches the preparation of a wet strength additive by glyoxalating an acrylamide copolymer having a molecular weight from about 500 to 6000. The resulting resins have limited stability in aqueous solution and gel after short storage periods even at non-elevated temperatures. Accordingly, the resins are typically supplied in the form of relatively dilute aqueous solutions containing only about 5–10 wt % resin.

Aminopolyamide-epichlorohydrin (APAE) resins have been used as wet strength additives for paper. U.S. Pat. No. 3,311,594, discloses the preparation of APAE wet strength resins. The resins are prepared by reacting epichlorohydrin with aminopolyamides, sometimes referred to as polyaminoamides, or polyaminourylenes containing secondary amino hydrogens. The APAE resins can also exhibit storage problems in concentrated form and gel during storage, although generally to a lesser extent than the GPA resins. As such, it has been common practice to dilute the APAE resins to low solids levels to minimize gelation. The APAE resins also are known to impart dry strength to paper, but the vast increase in wet strength which results simultaneously has made APAE resins unsuitable for use as dry strength resins in the preparation of recyclable paper.

U.S. Pat. No. 5,674,362 discloses a method for improving the strength of recycled paper by adding a mixed resin solution of APAE resin and GPA resin to the wet end of the paper-making process. The use of the mixed APAE:GPA resin solution produces paper which exhibits significantly increased dry strength performance as compared to the joint use of the resins individually.

It is an object of this invention to provide a method for improving the color retention and crocking of a dyed textile product.

SUMMARY OF THE INVENTION

The present invention is directed to a method for improving the color retention and crocking of a dye onto a textile fabric by post-treating the dyed fabric with (i) a glyoxylated acrylamide-diallyldimethyl ammonium chloride resin solution and (ii) an aminopolyamide-epichlorohydrin resin solution, preferably as a single mixed resin solution.

DESCRIPTION OF THE PREFERRED EMBODIMENTS

The present invention is directed to a method for improving the color retention and crocking of a dye onto a fabric by post-treating a dyed fabric with (i) a glyoxylated acrylamide-diallyldimethyl ammonium chloride resin solution and (ii) an aminopolyamide-epichlorohydrin resin solution. The resins serve to improve color fixation of the dyed textile product as compared to a dyed textile product which is not post-treated with the resins.

The GPA resin is prepared by first copolymerizing an acrylamide monomer with diallyldimethyl ammonium chloride (DADMAC) in aqueous solution, and then reacting the resulting copolymer with glyoxal, such as is disclosed in U.S. Pat. Nos. 3,556,932, and 4,605,702. Although not presently preferred, other comonomers may be used: methacryloyloxyethyl trimethyl ammonium methyl sulfate, methacryloyloxyethyl trimethyl ammonium chloride, acryloyloxyethyl trimethyl ammonium methyl sulfate, acryloyloxyethyl trimethyl ammonium chloride, acrylamidopropyl trimethyl ammonium chloride. The subject matter of each patent is incorporated herein by reference. A resin solution of GPA generally has a viscosity of less than about 150 cp and does not gel for at least 14 days when kept at room temperature as a solution containing 8 wt % resin.

Suitable acrylamide monomers for use herein may be any acrylamide, such as acrylamide per se, methacrylamide and the like. Moreover, up to about 10% by weight of the acrylamide comonomers may be replaced by other comonomers copolymerizable with the acrylamide, i.e. acrylic acid, acrylic esters such as ethyl acrylate, methylmethacrylate, acrylonitrile, styrene, vinylbenzene sulfonic acid, and the like. Generally, from about 75 to about 95 wt % acrylamide, and from about 5 to 25 wt % diallyldimethyl ammonium chloride are used.

In copolymerizing the acrylamide with the diallyldimethyl ammonium chloride, free radical generating initiators are generally added to an aqueous monomer solution. The polymerization takes place at a temperature that is generally between about room temperature and about 100° C. The resulting AM-DADMAC copolymer has an equivalent molecular weight that is generally in the range from about 500 to 100,000 daltons, preferably about 35,000 to about 50,000 daltons.

In reacting the resulting acrylamide-DADMAC copolymer and the glyoxal, the mole ratio of the glyoxal to the acrylamide portion of the copolymer is between about 0.7:1 to about 0.1:1, preferably about 0.5:1 to about 0.2:1, and more preferably about 0.35:1. The temperatures employed are preferably from about 25° C. to about 100° C., and the pH during the reaction is preferably kept within the range of about 3 to about 10. A suitable GPA resin may be obtained from Callaway Chemical Company, Columbus, Ga. under the trade name Discostrength® 19.

The APAE resin is prepared by reacting an aminopolyamide and epichlorohydrin in a conventional manner, such as is disclosed in U.S. Pat. Nos. 3,197,427, 3,442,754, and 3,311,594, the subject matter of each patent is incorporated herein by reference. APAE resin solutions have a viscosity of less than about 150 cp for at least 90 days when kept at room temperature as a solution containing about 12.5 wt % resin.

The aminopolyamide is formed by reacting a carboxylic acid with a polyalkylene polyamine under conditions which produce a water-soluble, long-chain polyamide containing the recurring groups:

$$—NH(C_nH_{2n}HN)_x—CORCO—$$

wherein n and x are each 2 or more and R is the divalent, organic radical of the dicarboxylic acid. Dicarboxylic acids useful in preparing the aminopolyamide include saturated aliphatic dicarboxylic acids, preferably containing from about 3 to 8 carbon atoms, such as malonic, succinic, glutaric, adipic, and so on, together with diglycolic acid. Of these, diglycolic acid and the saturated aliphatic dicarboxylic acids having from about 4 to 6 carbon atoms in the molecule, namely, succinic, glutaric, and adipic acids are the most preferred. Blends of two or more dicarboxylic acids may be used, as well as blends which include higher saturated aliphatic dicarboxylic acids such as azelaic and sebatic, as long as the resulting long-chain polyamide is water soluble or at least water dispersible.

Useful polyamines include polyalkylene polyamines such as polyethylene polyamines, polypropylene polyamines, polyoxybutylene polyamines. More specifically, the polyalkylene polyamines of this invention are polyamines containing two primary amine groups and at least one secondary amine group in which the nitrogen atoms are linked together by groups of the formula $—C_nH_{2n}—$ where n is a small integer greater than about 1, and the number of such groups in the molecule ranges from up to about eight, preferably about four. The nitrogen atoms may be attached to adjacent carbon atoms in the $—C_nH_{2n}—$ group or to carbon atoms further apart, but not to the same carbon atom. Specific polyamines include but are not limited to diethylenetriamine, triethylenetetramine, tetraethylenepentamine, dipropylenetriamine, and the like. Suitable polyamines for use in this invention also include mixtures and various crude polyamine materials, such as the polyamine mixture obtained by reacting ammonia and ethylene dichloride.

A preferred method for preparing the APAE resin entails reacting an aminopolyamide with epichlorohydrin in a mole ratio of epichlorohydrin to free amino groups of about 1:1 to 1.8:1, more preferably 1:1 to 1.5:1 in aqueous solution, and most preferably about 1.25:1. The temperature may vary from about 45° C. to about 100° C. Suitable APAE resins are commercially available and may be obtained from several sources including Callaway Chemical Company, Columbus, Ga. under the trade name Discostrength® 5800.

The GPA and APAE resins are generally used at a weight ratio of from about 0.5:1 to about 5:1. Preferably, the GPA:APAE weight ratio is from about 0.8:1 to 4:1, and more preferably it is from about 1:1 to 2:1.

In the present invention, the resins are deposited onto a dyed textile from a single resin solution at a sufficiently high concentration that the deposition results in a sufficient amount of resin to impart the desired improved crockfastness to the textile. Generally, the resin solution contains from about 0.3 to 2.5 wt % resin, preferably from about 0.5 to 1.5 wt % resin.

The amount of resin deposited onto the fabric, i.e. the add-on, generally ranges from about 0.1 to 2 wt % on weight of dry fabric. Preferably the solids add-on is about 0.3 to 1.5 wt %. The actual amount, however, may vary depending upon factors such as the degree of crockfastness to be obtained, the resin concentration of the resin solution, the temperature, and the equipment used.

In addition to water and the resins, the resin solution may contain one or more textile softeners. Suitable such softeners include those based upon both fatty acids, silicones, and high density polyethylenes. Preferably a cationic fatty acid based softener such as Callasoft IFF sold by Callaway Chemical Co. is used. When present, the softener is generally used in an amount to provide a solids add-on of about 0.1 to 1 wt %, although higher amounts may be used if desired. The solution from which the softener is deposited onto the fabric generally contains about 0.1 to 1 wt % softener.

The resin solution may also contain other post-treatment additives provided that they do not deleteriously interact with the resins. The resin solution can be effectively applied to a predyed textile fabric by the "tub" or impregnation method, but is more conveniently applied by padding at a temperature of about 25 to 65° C., preferably about 35 to 50° C. After the amount of resin is applied to obtain the desired dry pick-up, the treated textile fabric is dried at an elevated temperature. The resin solution may also be applied by spraying, coating, or any other method used in the application of liquid solutions to dyed fabrics and other textile materials.

This invention imparts improved crockfastness to a dyed fabric, as measured by a crocking test, generally using AATCC Test Method 8-1981 entitled "Colorfastness to Crocking: AATCC Crookmeter Method." In the test, a colored test specimen fastened to the base of a crockmeter is rubbed with white crock test cloth under controlled conditions. Color transfer to the white cloth is estimated by a comparison with the AATCC Chromatic Transferance Scale or Gray Scale for Staining.

Dyed fabrics used in this invention are generally anionic and include 100% cellulosic materials such as cotton as well as blends with other fibers such as polyester. Dyed cellulosic textile materials such as indigo-dyed denim and double black sulfur dyed 100% cotton denim twill may be processed in accordance with this invention. In addition, knits and other woven fabrics dyed with reactive and/or pigment dyes may be used.

For a fuller understanding of the nature and advantages of this invention, reference may be made to the following non-limiting examples in which all parts and percents are by dry weight unless otherwise specified.

EXAMPLE 1

To evaluate the present invention on sulfur overdyed black denim, the following is performed. After a sample of dyed fabric is desized by detergent washing, the sample is treated with a GPA:APAE mixed resin solution. The GPA:APAE resin solution has a resin weight ratio of 1:1 and was prepared according to the following procedure. A GPA resin solution (Discostrength® 19 having 8.0 wt % resin solids and a glyoxal to polymer ratio of 0.325) is obtained from Callaway Chemical Co. An APAE resin solution (Discostrength® 5800 having 12.5 wt % resin solids) is obtained from Callaway Chemical Co. The APAE resin solution is placed in a mixing vessel equipped with a motor-driven stirrer and thermometer and the GPA resin solution added thereto to produce the desired weight ratio. The mixture is stirred until a uniform resin solution is visually produced.

To a 1% 1:1 GPA:APAE resin solution is added 0.6% of a cationic fatty acid softener (Callasoft IFF) and the solution is exhausted on at 110° F. for 8 minutes and a water to fabric ratio of 5 to 1. The fabric is then dried at 225° F. for 12 minutes and evaluated for wet crock using AATCC Test Method 8-1981 entitled "Colorfastness to Crocking: AATCC Crookmeter Method."

The wet crock rating is increased from a 1 on a desized-only fabric to a 3.

EXAMPLE 2

The procedure of Example 1 is repeated except reducing the resin content of the GPA:APAE solution from 1% to 0.5%. The wet crock rating is increased, but only from a 1 to a 2.

EXAMPLE 3

The procedure of Example 2 is repeated except that the cationic fatty acid softener was replaced by (i) a high density polyethylene softener or (ii) a silicone softener. The total resin content is 0.5%. As in Example 2, the wet crock rating is increased from a 1 to a 2.

EXAMPLE 4

The procedure of Example 1 is repeated except that the treatment solution contained 1% resins (1:1) and 99% water, i.e. without any softener. The solution is padded onto 100% cotton twill fabric and the fabric dried. The wet crock rating increases.

EXAMPLE 5

The procedure of Example 4 is repeated with a treatment solution contained 1% resins (1:1) and 99% water, i.e. without any softener. Before the solution is padded onto 100% cotton twill fabric and the fabric dried, three 10 inch segments are marked in both the warp and fill directions. After drying, one home laundering was performed and the 10 inch segments are re-measured to calculate shrinkage.

The results show shrinkage of only about 3/16 of an inch in each direction, far less than for a fabric processed in the absence of the resins show shrinkage of about 1 inch in each direction.

EXAMPLE 6

The procedure of Example 1 is repeated except that the ratio of GPA resin to APAE resin is varied.

When the ratio is reduced from 1:1 to 1:3 and the same 1% total resin used, no improvement in either wet or dry crock occurs as compared to an untreated standard sample.

When the ratio is increased from 1:1 to 1.86:1 and the same 1% total resin used, the wet crock increased to 3.5 as compared to an untreated standard sample.

What is claimed is:

1. In a process of preparing a dyed textile fabric wherein a dye solution is deposited onto a textile fabric, the improvement comprising coating the dyed textile fabric with (i) a glyoxylated acrylamide-diallyldimethyl ammonium chloride resin and (ii) an aminopolyamide-epichlorohydrin resin, wherein the glyoxylated acrylamide-diallyldimethyl chloride resin and the aminopolyamide-epichlorohydrin resin are coated onto the dyed textile in a weight ratio of about 0.5:1 to about 5:1.

2. The process of claim 1, wherein the glyoxylated acrylamide-diallyldimethyl ammonium chloride resin and the aminopolyamide-epichlorohydrin resin are deposited from a single resin solution.

3. The process of claim 2, wherein the weight ratio is from about 0.8:1 to 4:1.

4. The process of claim 2, wherein the weight ratio is from about 1:1 to 2:1.

5. The process of claim 2, wherein the resin solution contains from about 0.3 to 2.5 wt % total resin.

6. The process of claim 2, wherein the resins are present in an amount sufficient to produce an add-on of about 0.1 to 2 wt %.

7. The process of claim 2, wherein the resin solution further contains a textile softener.

8. The process of claim 7, wherein the textile softener is selected from the group consisting of cationic fatty acid, silicone, and high density polyethylene softeners.

9. The process of claim 7, wherein the softener is present in an amount which provides a solids add-on of about 0.1 to 1 wt %.

10. In a process for after treating a dyed textile fabric, the improvement comprising aftertreating the dyed textile fabric by applying a finish in an amount sufficient to improve wet crockfastness, the finish comprising effective amounts of a blend of (i) a glyoxylated acrylamide-diallyldimethyl ammonium chloride resin and (ii) an aminopolyamide-epichlorohydrin resin, wherein the glyoxylated acrylamide-diallyldimethyl chloride resin and the aminopolyamide-epichlorohydrin resin are applied in a weight ratio of about 0.5:1 to about 5:1, and drying the resins in the finish in situ on the textile fabric.

11. The process of claim 10, wherein the weight ratio is from about 0.8:1 to 4:1.

12. The process of claim 10, wherein the weight ratio is from about 1:1 to 2:1.

13. The process of claim 10, wherein the finish contains from about 0.3 to 2.5 wt % total resin.

14. The process of claim 10, wherein the resins of the finish are present in an amount sufficient to produce an add-on of about 0.1 to 2 wt %.

15. The process of claim 10, wherein the finish further contains a textile softener.

16. The process of claim 15, wherein the textile softener is selected from the group consisting of cationic fatty acid, silicone, and high density polyethylene softeners.

17. The process of claim 15, wherein the softener is present in an amount which provides a solids add-on of about 0.1 to 1 wt %.

* * * * *